US005524320A

United States Patent [19]

Zachhuber

[11] Patent Number: 5,524,320

[45] Date of Patent: Jun. 11, 1996

[54] FLOOR SCRUBBING MACHINE

[76] Inventor: Kurt Zachhuber, Karlstr. 111, D-8122 Penzberg, Germany

[21] Appl. No.: 94,138

[22] PCT Filed: Jan. 30, 1992

[86] PCT No.: PCT/EP92/00198

§ 371 Date: Feb. 28, 1994

§ 102(e) Date: Feb. 28, 1994

[87] PCT Pub. No.: WO92/13480

PCT Pub. Date: Aug. 20, 1992

[30] Foreign Application Priority Data

| | | | |
|---|---|---|---|
| Feb. 1, 1991 | [DE] | Germany | 41 03 087.7 |
| Dec. 18, 1991 | [DE] | Germany | 9115713 U |
| Jan. 13, 1992 | [DE] | Germany | 42 00 630.9 |

[51] Int. Cl.[6] ..... A47L 11/16; A47L 11/30

[52] U.S. Cl. ..... 15/320; 15/50.1; 15/368; 15/401

[58] Field of Search ..... 15/320, 49.1, 50.1, 15/368

[56] References Cited

U.S. PATENT DOCUMENTS

| | | | |
|---|---|---|---|
| 3,277,511 | 10/1966 | Little et al. | 15/320 |
| 3,345,671 | 10/1967 | Wilson et al. . | |
| 3,866,541 | 2/1975 | O'Connor et al. . | |
| 3,942,214 | 3/1976 | Maasberg | 15/320 |
| 4,490,873 | 1/1985 | Stratton | 15/320 X |
| 4,492,002 | 1/1985 | Waldhauser et al. | 15/320 |

FOREIGN PATENT DOCUMENTS

| | | |
|---|---|---|
| 0424229 | 4/1991 | European Pat. Off. . |
| 2657769 | 8/1991 | France . |
| 1446121 | 8/1976 | United Kingdom . |

*Primary Examiner*—Chris K. Moore
*Attorney, Agent, or Firm*—Helfgott & Karas

[57] ABSTRACT

A floor scrubbing machine has a floor scrubbing device with at least two floor scrubbing elements, of which at least one is mounted to a chassis to be adjustable in such a manner that the operating width of the floor scrubbing device can be changed. An adjustable vacuum element or an adjustable strip-like member can be connected to at least one adjustable floor scrubbing element. The strip-like member follows the movements of the adjustable scrubbing element. The adjustable vacuum element and/or the adjustable strip-like member is connected to a vacuum device whose working width will be adapted automatically to the working width of the floor scrubbing device.

9 Claims, 4 Drawing Sheets

FLOOR SCRUBBING MACHINE

BACKGROUND OF THE INVENTION

The present invention pertains to a machine for the scrubbing of floors including a moving chassis, a floor scrubbing device, in particular a grinding, polishing or scrubbing device, and a vacuum unit, where the floor scrubbing device has at least two rotating scrubbing elements, in particular grinding, polishing or scrubbing elements, of which at least one is adjustable to vary the operating width of the floor scrubbing device, and where the vacuum device is composed of at least one vacuum head located near the floor in the working direction behind the floor scrubbing device, and connected with the adjustable scrubbing element there is an adjustable vacuum element that sends particles located on the floor and/or liquid to the vacuum head so that the operating width of the vacuum device will be adapted automatically to the working width of the floor scrubbing device.

A floor scrubbing machine of this kind is known from U.S. Pat. No. 3,345,671. Now, this known machine is designed as a kind of scrubbing vacuum and polishing machine and has two adjustable plate brushes located in the working direction in front of a fixed plate brush. In case of a narrow working width, the two adjustable brushes will be retracted toward the middle of the machine. In this position they will clean the floor even in the region where the fixed brush is cleaning the floor. Thus the floor will be scoured in the outer regions of the working width of the machine only by one particular brush, whereas in the middle region a double scouring will occur. This will lead to an adverse element formation on the cleaned floor.

Another related type of floor scrubbing machine is known from U.S. Pat. No. 3,866,541. This machine is likewise designed as a scrubber vacuum cleaner and has one adjustable and one fixed plate brush. The problem described above will occur similarly for this machine as well.

One additional floor scrubbing machine with an adjustable working width is known from U.S. Pat. No. 3,277,511. It is designed as a scrubber vacuum cleaner and has a front mounted scrubber head that is formed by the placement of several plate brushes in a line side by side. This elongated scrubber head is pivot mounted to the chassis about a vertical axis so that one of the plate brushes can move along a circular path. Depending on the adjusted position of the scrubber head (transverse or more or less oblique to the working direction) the working width defined by the projection of the scrubber head in the working direction is adjustable. The working width of the vacuum device which is composed of a vacuum strip connected with the vacuum head and positioned in the rear region of the machine, thus can be adapted to the working width of the scrubber device so that a lateral extension, which is pivot mounted to the vacuum element about a vertical axis, will be pivoted out more or less to a significant extent.

The disadvantage of these machines rests particularly in their poor handling ability and in low operating ease. Since the extension of the vacuum element protruding over the working width of the floor scrubbing device can get caught on obstacles, it can damage adjacent articles or itself and result in injury of a user. Furthermore, during the continually changing working width of the scrubber device, for example, due to obstacles in the working area, for example chair legs and similar features, a continual, permanent adaptation of the working width of the vacuum device by hand is very time-consuming. A further disadvantage rests in an unsatisfactory, nonuniform operation. Since, on the one hand, in tight curve motions of the scrubber vacuum cleaner according to U.S. Pat. No. 3,277,511, an area in an inner curve will not be covered by the scrubber device so that this area will remain moist; and on the other hand, the removal of the liquid film in a relatively large region will not be possible, for example, when cleaning the corners of a room when the machine is moved forward up to the wall and is then moved backward away from the wall. The known scrubber vacuum cleaners with variable working width thus are not used in practice. And the same problems exist for other floor scrubbing machines designed according to the same principle, like, e.g., scrubber and polishing machines, regardless of whether liquid or particle-like solids (abrasives) are to be vacuumed up.

SUMMARY OF THE INVENTION

It's an object of the present invention to improve the operation of the floor scrubbing machines with an adjustable working width..

According to this invention, this and other objects are attained by the floor scrubbing machine which prevents a double scrubbing of the floor in regions where the working regions of two scrubbing elements overlap, since one of the two scrubbing elements is brought out of contact with the floor in this region. Regardless of the working width of the floor scrubbing machine already adjusted, a multiple processing of the floor thus will no longer occur. The formation of undesirable moist areas will thus be safely prevented.

The principle underlying the invention can be implemented on all floor scrubbing machines that have a rotating scrubbing element composed of a floor scrubbing device with an adjustable working width, in particular for machines with abrasive, polishing or scouring units. The corresponding scrubbing elements, in particular abrasive, polishing or scouring elements can likewise have any configuration known to the state of engineering; in particular, they can be designed as plate brushes, roller brushes, abrasive disks or pads. The scrubber vacuum cleaner illustrated below with a rotating brush has advantages that apply accordingly also to the other floor scrubbing machines. Solely for reasons of clarity, where this appears useful, reference will be made to the actual design as a scrubber vacuum cleaner.

The device provided on the machine according to the invention to prevent a double scrubbing of the floor is composed preferably of at least one cover plate with a respective brush near the floor, on which the bristles of the brush run along in the region where the bristles of the other brush are in contact with the floor. The term "region" in this case is meant to be the area of the floor being cleared, directed in the working direction that is being treated by the corresponding brush during the forward movement of the machine in the working direction. Thus, the cover plate will prevent a multiple scrubbing of the floor, since the floor contact with the bristles of the one brush will be prevented in the region where the bristles of the other brush are cleaning the floor. Thus, the floor will be cleaned uniformly over the entire working region of the floor scrubbing machine, regardless of the particular adjusted working width, so that the formation of undesired areas due to multiple scrubbing will be reliably avoided.

In the case where the floor scrubbing machine has at least one main brush unit positioned at the front of the machine, it is useful to provide a single cover plate whose width corresponds to the working width of the main brush unit. In the case of floor scrubbing machines without a main brush unit with two supplemental brush units located one behind the other in the working direction, it is useful to connect the one brush unit with an adjustable cover plate in the region of the second brush unit; for example, in this case the cover plate is located in the region of the rear brush unit and is coupled with the front brush unit and displaced during a change in the working width. In this case, the cover plate will have a width corresponding to the working width of the front group of brushes, and this will prevent the rear group of brushes from operating in the region where the front group of brushes has just cleaned the floor. In this kind of configuration of the floor scrubbing machine according to this invention, one particular advantage is obtained in that both brush units can be moved in both directions out from their middle position; given a correspondingly large working width the front brush unit thus can move out to the left and the rear brush unit can move out to the right, or also the front brush unit can move out to the right and the rear brush unit can move out to the left from the chassis. This is an advantage in the cleaning of corners of the room. In another useful design of the floor scrubbing machine according to this invention that prevented double processing and having two brush units positioned one behind the other, a cover plate is provided in fixed position in the region of each of the brush units. Both cover plates are to be preferably essentially half as wide as the working width of the corresponding, allocated brush unit; they are positioned offset to each other, so that the covered regions will not overlap, but rather are adjoined with the middle of the machine. For example, with regard to this kind of floor scrubbing machine, the cover plate allocated to the front brush unit will cover the left half of the (retracted) brush group, while the cover plate allocated to the rear brush unit will cover the right half of the (retracted) rear brush unit. With this kind of floor scrubbing machine the front brush unit will always process the working area located to the right of the middle of the machine, while the rear brush unit will clean the working area located to the left of the middle of the machine, regardless of the particular working width set at the moment. The front brush unit in this case will only extend to the right, and the rear brush unit to the left.

A further configuration of the device that will prevent a double scrubbing of the floor by floor scrubbing machines with plate brushes, is such that the bristle holders are combined into casings that can be displaced in an axial direction in the plates, so that each bristle holder will be pressed onto the floor by a spring element acting on the casing; an electromagnet located above the plate brushes will attract the casing held in one plate brush against the force of the spring element in the regions where another brush is cleaning the floor, so that the bristle holder held in the particular casing will be brought out of contact with the floor in the corresponding region.

As for the machine according to the related U.S. Pat. No. 3,345,671, an adjustable vacuum element or an adjustable scrubber member is coupled to each adjustable scrubbing element; said scrubber member sends particles and/or liquid located on the floor to the vacuum head or to the vacuum element connected to it, so that the working width of the vacuum device will be adapted automatically to the working width of the floor scrubbing machine. Due to the coupling (preferably mechanical) with the corresponding adjustable scrubbing element, as this element moves, the corresponding vacuum element or the corresponding scrubber member will also be moved accordingly when the working width of the floor scrubbing machine is being changed. The scrubber member located in the working direction behind each adjustable processing element is used to guide the water or particle film left behind on the floor inward and to send it to the region covered by a central vacuum element. The separate vacuum element provided as an alternative behind every adjustable scrubbing element, will likewise remove the water or particle film left behind on the floor by the scrubbing element. To do this, it is preferable to connect the scrubbing element to a central vacuum device, that is, to a central vacuum fan and a central separator device.

It is particularly useful when the adjustable vacuum element coupled with every adjustable scrubber brush, or the corresponding scrubber element, is located directly behind the corresponding brush, that is, at the smallest possible distance from it. This will minimize the region of the floor where a vacuuming of the liquid film will not occur due to a curved motion or when using the scrubber vacuum cleaner with a back and forth motion. If necessary, the corresponding, adjustable vacuum elements or scrubber elements can be located under the chassis of the scrubber vacuum cleaner in order to minimize the region where the vacuuming is omitted.

The configuration of the brushes of the scrubber vacuum cleaner can be arranged in numerous ways. For example, one or more front mounted, fixed-position main brush can be provided, and also behind it, in the working direction, one or two adjustable supplemental brushes may be provided. In a different, useful configuration of the scrubber vacuum cleaner according to this invention, exclusively adjustable brushes, possibly combined into units, are provided that are located one behind the other in the working direction. The latter configuration has the advantage that the corresponding floor scrubbing machine can be of very a compact design and is also able to clean corners of the room while retaining a large working width.

With regard to the scrubber vacuum cleaner according to this invention, roller brushes and plate brushes can be used in the same way. In general, roller brushes will be positioned to rotate transverse to the working direction; plate brushes are to be combined preferably into groups or units of at least two brushes that are positioned side by side transverse to the working direction and that are counter-rotating, so that the plate brushes forming a group can be moved together to change the working width.

The term "main brush" will be used below synonymously for "fixed-position brush" and the term "supplemental brush" will be used synonymously for an "adjustable brush."

A high degree of flexibility in the use of the scrubber vacuum cleaner will be obtained when it has a central main brush unit and two adjustable supplemental brush units located behind it of which one brush unit is adjustable to protrude to one side, and the other to protrude to the other side, from the working region of the main brush unit. The particular position of each of the two supplemental brush units in this case is selected preferably independently of the position of the other supplemental brush unit. The mounting of the two supplemental brushes in the scrubber vacuum cleaner in this case can be symmetrical to its longitudinal axis, that is, in the retracted position the two supplemental brushes are located side by side. In this case the working width of the single, supplemental brushes is limited to nearly half the working width of the main brush, that is, the total working width of the machine can be varied in a ratio of about 1 to 2. However, the two supplemental brushes can also be positioned in an echelon one behind the other in the longitudinal direction of the machine. In this case, the working width of the supplemental brushes can be nearly equal to the working width of the main brush, that is, the total working width can be varied in a ratio of nearly 1 to 3. In order not to make the handling of the machine too difficult due to an excessive length, this kind of configuration of the supplemental brushes can be provided in particular when using roller brushes.

In order to improve the adaptation of the scrubber members or of the vacuum elements to the various possible positions of the supplemental brushes, the inner ends of the scrubber members and/or vacuum elements preferably run in the longitudinal guides, while the outer ends are securely connected to the covers or frames allocated to the supplemental brushes. In one particularly preferred design of the scrubber vacuum cleaner according to this invention, the vacuum elements or scrubber members coupled with the adjustable brushes represent a telescoping extension of the central vacuum element. That means that the inner ends of the scrubber members or vacuum elements will run into or up to the vacuum element. This will produce a very compact and highly efficient design of the elements used to vacuum up the water film.

In the working direction in front of the supplemental brushes there are preferably ejector bars that prevent table legs or similar items from getting between the housing of the scrubber vacuum cleaner and an extended supplemental brush. Ejector bars also held on their one ends to a fixed point and at their other ends in a longitudinal guide in order to allow them to adapt to the different possible positions of the supplemental brushes. In this case it is preferable to articulate the front end of each ejector bar at a fixed point at the chassis of the scrubber vacuum cleaner, while the respective rear end thereof will slide in a longitudinal guide that is provided at the cover or at the frame of each supplemental brush.

There are different possibilities available for attachment of the supplemental brushes to the scrubber vacuum cleaner. For example, the supplemental brushes can be mounted to pivot arms whose other end is articulated to the chassis of the scrubber vacuum cleaner; the various possible positions of the supplemental brushes in this case rest on a circular path. Furthermore, a linear movement of the supplemental brushes will be possible in a guide positioned transverse to the working direction of the scrubber vacuum cleaner. This kind of mounting of the supplemental brushes is useful in particular in the scrubber vacuum cleaners that have adjustable brushes or brush groups exclusively. In this case it is preferable to mount the brushes or groups of brushes in a frame designed as a skid, where the frame is mounted, for example, on two guide rails by using guide rollers, and these guide rails are provided at the underside of the chassis. Finally, it can be an advantage, in particular when using roller brushes as supplemental brushes, to pivotally mount them to the scrubber vacuum cleaner by using a parallelogram guide.

The drive unit for the supplemental brushes can be provided by a mechanical or hydraulic coupling with the drive unit for the main brush. This configuration is comparatively not expensive. The mechanical coupling of the main brush and supplemental brushes will preferably have a speed translation, that is, the supplemental brushes will rotate at a higher speed than the main brush. In this manner the scrubbing effect reduced by the smaller contact pressure of the supplemental brushes on the floor compared that of to the main brush, will be compensated by a greater frequency of the scrubber bristles, so that the main brush and the supplemental brushes will have the same cleaning power. However, each supplemental brush can also have its own drive motor. In this form of the drive, each supplemental brush can be set out of operation as soon as it moves to its fully retracted position (minimal operating width) so that any unnecessary wear on the bristles will be avoided.

The scrubber vacuum cleaner according to this invention can have spring elements that bring the supplemental brushes into their final, extended position. When a supplemental brush extended in this manner under spring force runs up against an obstacle with its extended ejector bar, then the affected supplemental brush will be pressed inward by the obstacle against the spring force, but only enough to pass by the obstacle. In this way the entire working width will be adapted automatically to the particular local space. Alternatively, a change in the position of the supplemental brushes by means of a known hydraulic cylinder can be taken into consideration. The change and of the position of the brushes may be attained also by means of servomotors.

At the leading edge of the adjustable brush or brush units it is useful to provide a sensor bar that is connected with a sensor switch. When the corresponding brush or brush group runs up against an obstacle, then the sensor switch will be operated by the sensor bar and control the position change of the corresponding brush/group of brushes in order to effect a reduction in the working width. In the case of a hydraulically controlled working width with a sensor switch it should be connected to a valve that controls the actuation of the hydraulic cylinder used for the positional change of the brush or group of brushes in such a manner that the corresponding brush or group of brushes will be retracted.

Sample designs of the floor scrubbing machine according to this invention will be explained in greater detail below with reference to the figures.

DETAILED DESCRIPTION OF THE PREFERRED EMBODIMENTS

Figure 1:
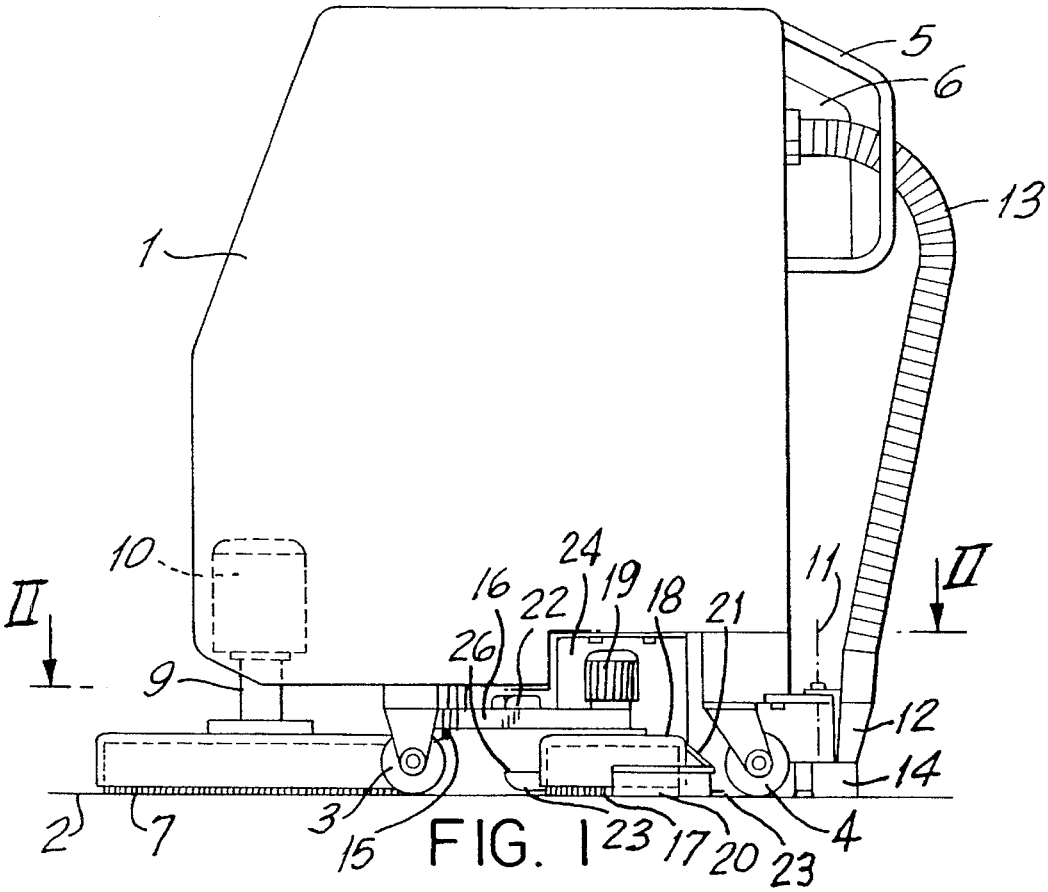
FIG. 1 is a side view of an embodiment of a floor scrubbing machine according to the invention, with one main brush and two supplemental brushes and two scrubber members located behind them.

The scrubber vacuum cleaners illustrated in FIGS. 1–6 have a housing 1 in which the various aggregates and containers are housed, like a vacuum fan, separator devices for a picked up dirt, a supply tank and the dosing device for the scrubbing liquid and similar materials. The housing 1 is supported on three rollers on the floor 2 where two rollers are nonsteerable idle rollers 3 and the third roller is designed as a guide roller 4 that pivots about a perpendicular axis. At the rear end of the housing 1 there are two handles 5 by which the operator can control the scrubber vacuum cleaner. A control console 6 located between the handles 5 contains the control and operating instruments necessary for operation. To this extent the design of the illustrated scrubber vacuum cleaners is identical to those according to the state of the art.

Likewise known from the state of engineering, and thus not described in detail, is the placement of a scouring brush rotating about a vertical axis in the front region of the scrubbing vacuum cleaner (FIGS. 1–4, and 6). In the terminology of the present application, the scrubbing vacuum cleaner according to FIGS. 1–4 and 6 has a main brush 7 designed as a plate brush that is covered by a main brush hood 8. In this case, the main brush hood will be supported by means of a hollow support 9 by the housing, where, in the interior of the hollow support the drive shaft is running which will transfer the drive power from the main brush drive unit 10 to the main brush 7. At the rear end of the scrubbing vacuum cleaner according to FIGS. 1–5 there is a vacuum head 12 pivotally mounted about a vertical axis 11; this vacuum head is connected by a vacuum hose 13 to the vacuum fan located in the interior of the housing 1. The vacuum element 14 extends outwards from both sides of the vacuum head 12; this vacuum element has a rubber lip that slides on the floor and feeds the liquid to be sucked up to the vacuum head. The vacuum element 14 in this case protrudes beyond the housing 1 of the scrubbing vacuum cleaner in order to assure a reliable pick up of the entire liquid film.

Figure 2:
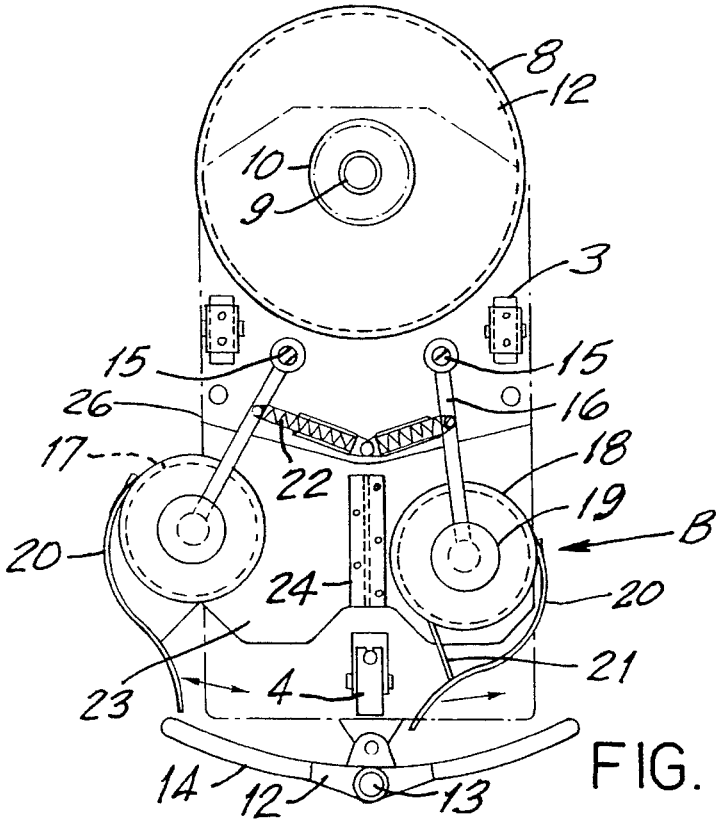
FIG. 2 is a horizontal cross section through the scrubber vacuum cleaner taken along line II—II of FIG. 1.

The scrubber vacuum cleaner illustrated in FIGS. 1, 2, 4 and 6 has two pivot lugs 15 on the underside of the chassis, to each of which a pivot arm 16 is pivotally mounted about a vertical axis. Opposite the articulation point of each pivot arm 16 there is a supplemental brush device consisting of a supplemental brush 17 designed as a plate brush. A supplemental brush hood 18 covers the supplemental brush and a supplemental brush drive 19. In the working direction behind the supplemental brushes there is a scrubbing member 20 for the machine according to FIGS. 1 and 2 which is attached externally to the supplemental brush hood 18 and is internally pressed against the floor 2 by an additional support 21 that is also attached to the supplemental brush hood (in FIG. 1 the scrubber strip-like member 20 is shown without its rear section so that the components located farther to the inside such as cover plate 23, and guide roller 4 can be seen). The two scrubber members 20 in this case run at an angle to the rear and, then converge towards each other and, in this way, guide the water film left behind by the supplemental brushes into the central region passed over by the vacuum element 14. Each of the two pivot arms 16 will be pressed outward to the side by one spring arm 22, provided that the supplemental brush hoods do not encounter an obstacle. Only to illustrate the various, possible positions of the supplemental brushes, the right supplemental brush is shown in FIG. 2 in its retracted position (B) and the left supplemental brush is illustrated in its partially extended position.

In the region of the supplemental brushes a cover plate 23 extends across the entire width of the main brush 7 of the scrubber vacuum cleaner according to FIGS. 1, 2, 3 and 5. This cover plate 23 is attached to the underside of the housing 1 by using screws 25 by means of a holder 24 riveted to the plate. The cover plate 23 is suspended so that it will be moved at a short distance above the floor 2. The front edge 26 of the cover plate 23 is curved upwards in order to allow escape of the cover plate upwards when the machine runs up onto a possible obstacle or when it passes over an unevenness in the floor.

Figure 3:
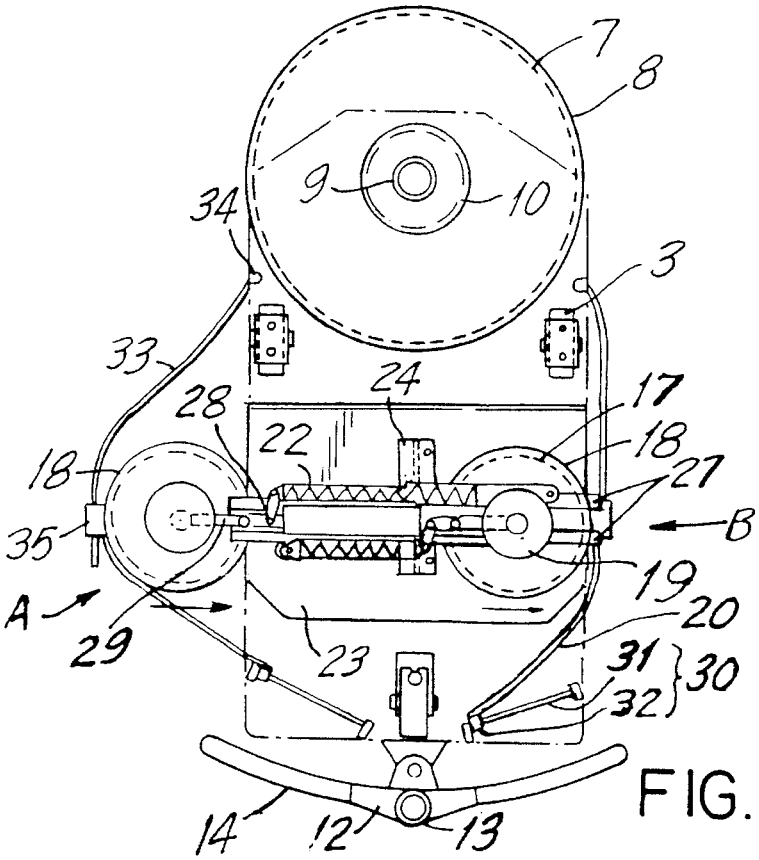
FIG. 3 is a horizontal cross section through a scrubber vacuum cleaner according to the invention with a linear guide for the supplemental brushes and with scouring members located behind them.

The scrubber vacuum cleaner shown in FIG. 3 differs from that according to FIGS. 1 and 2 essentially only in the design of the articulation of the supplemental brushes relative to the machine and accordingly in the manner in which the position adjustability of the supplemental brushes is effected. According to FIG. 3 a linear guide for the two supplemental brush units is provided, which is composed of two mutually parallel and opposing guide elements 27 running transverse to the longitudinal axis, and a slide element 28 that can slide into the rocker arm represented by the guide elements 27. The two guide elements 27 in this case are positioned at a distance from each other so that the hollow support that connects the supplemental brush drive unit 19 and the particular supplemental brush hood 18 together can pass between them and so that the particular drive shaft for the supplemental brush 17 can also pass through. The corresponding hollow support is attached to the slide element 28 by a support arm 29. The guide elements 27 used as rocker arms and the slide elements 28 are adjusted to each other so that the transfer of both horizontal and also vertical forces will be possible. Spring legs 22 that are articulated to the guide element 27, on the one hand, and to a lever actuating the slide element 28, on the other hand, press the slide elements 28 and thus the supplemental brush units suspended from them, outward to the side. Thus the supplemental brushes automatically take on the extended position (A) provided that they are not forced by an obstacle into the retracted position (B) or into any other intermediate position.

The scrubber members 20 according to FIG. 3 are attached at their outer ends in turn to the particular supplemental brush hood 18, while longitudinal guides 30 are provided for mounting of their inner ends. These guides consist of one guide rod 31 securely attached to the chassis and one slide piece 32 sliding on it, to which the inner end of the particular scrubber member 20 is securely attached. The two guide rods 31 run at an angle to the rear, toward each other, in order to create an effective transport of the water film to the interior of the machine.

According to FIG. 3, in the working direction, ejector bars 33 are provided in front of the supplemental brush units that prevent table legs or similar items from getting between the housing and one supplemental brush. Every ejector bar 33 is articulated at its front end at a mounting point 34 provided on the chassis. The rear end of each ejector bar 33 is longitudinally adjustable and is run into a guide casing 35 that is attached to the particular supplemental brush hood 18. In this manner the ejector bars 33 can be optimally adapted to the particular position of the corresponding supplemental brush unit. Otherwise the configuration of the scrubber vacuum cleaner according to FIG. 3 corresponds to that of the scrubber vacuum cleaner illustrated in FIGS. 1 and 2, so that any further explanation in this regard is unnecessary.

In the scrubber vacuum cleaner according to FIG. 4, the guide of the supplemental brush is provided as is described in connection with FIGS. 1 and 2. But in contrast to FIGS. 1 and 2, where an ejector bar is provided behind the supplemental brush that directs the water film on the floor to the vacuum element 14 located at the rear of the machine, the embodiment shown in FIG. 4 has two vacuum elements designed as vacuum spouts 46 in the travelling direction behind the supplemental brush. The vacuum spouts 46 are securely attached to the supplemental brush hoods 18; their structure corresponds essentially to that of the vacuum element 14. The support 47 for connection of the vacuum hose is located in the interior of each vacuum spout. The vacuum spouts 46 are connected by means of the corresponding vacuum hoses to the vacuum fan to which the vacuum element 14 is also connected.

Figure 5:
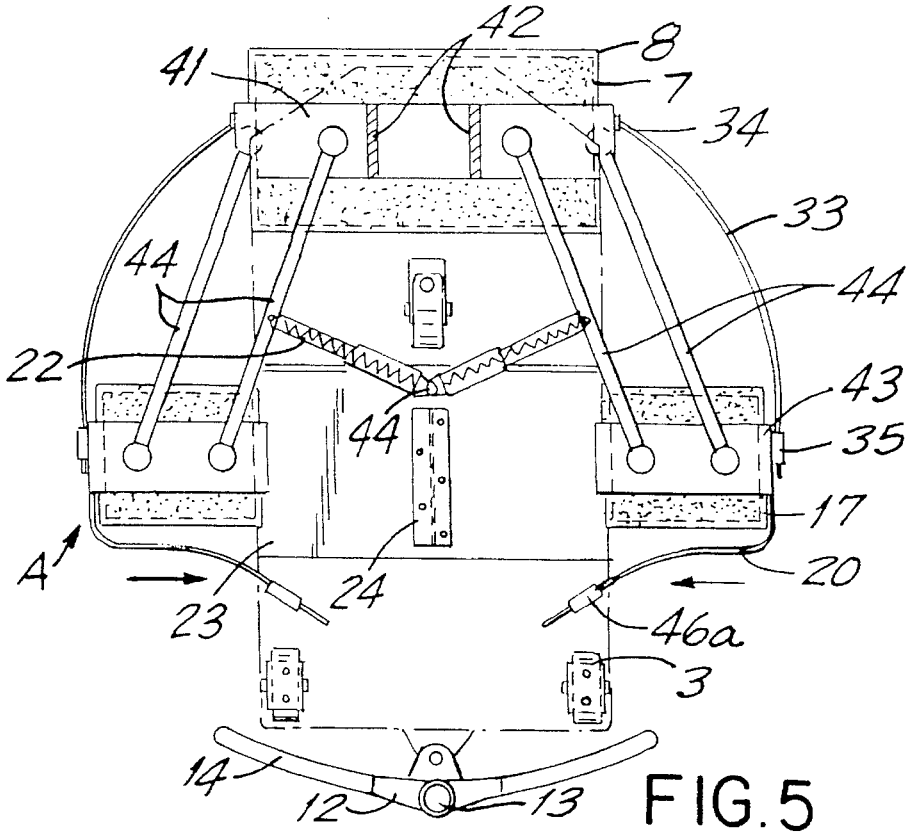
FIG. 5 is a horizontal cross section through a scrubber vacuum cleaner with supplemental brushes designed as roller brushes mounted to parallel guides.

In the embodiment of FIG. 5, both the main brush 7 and also the supplemental brushes 17 are designed as roller brushes with a horizontal, transverse running rotational axis. The main brush 7 in this case is held in a downwardly open, U-shaped frame 41 that is attached to the underside of the housing by means of two supports 42. Also, the supplemental brushes 17 are seated in corresponding U-shaped, downwardly open frames 43 that are in turn articulated by means of a parallelogram guide composed of two guides 44 to the frame 41 of the main brush 7. Each of the parallelogram guides has been allocated one spring leg 22 that is tensioned between a central, fixed-housing articulation point 45 and the particular interior of the two guides 44 and presses the supplemental brushes units outward to the side.

The scrubber members 20 have their outer ends connected securely to the particular outer section of the corresponding frame 43. Guide eyelets 46 are provided at the housing to control the inner ends of the scrubber members 20. The scrubber member 20 runs in and is length-adjustable in said eyelets. Thus an essentially smooth adaptation of the guide strips to the particular setting of the supplemental brush unit is provided as has been described in connection with FIG. 3. The configuration of the ejector bars 33 and of their mounting was already described in connection with FIG. 3.

Figure 4:
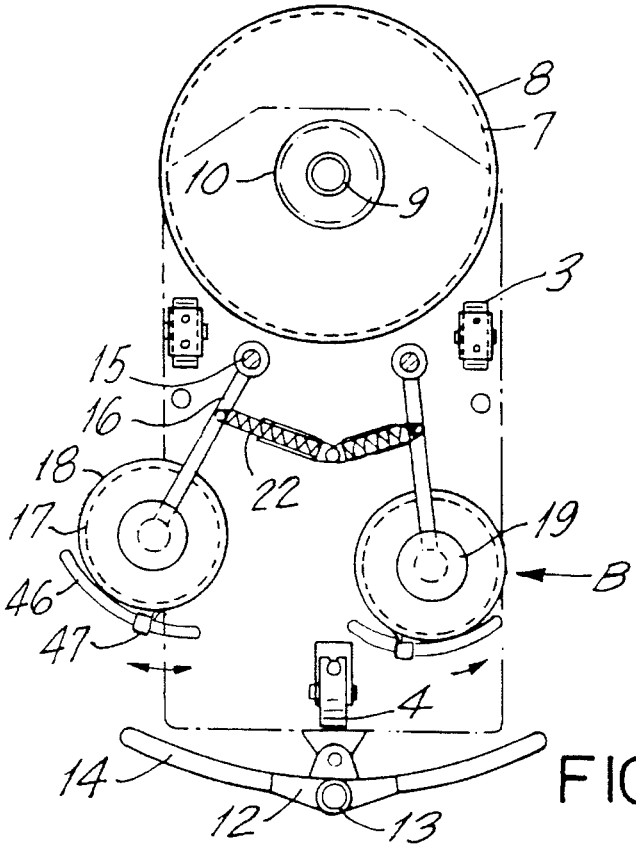
FIG. 4 is a horizontal cross section through a scrubber vacuum cleaner with a supplemental brush of the configuration according to FIGS. 1 and 2, where a vacuum element is located behind each of the supplemental brushes.
Figure 6:
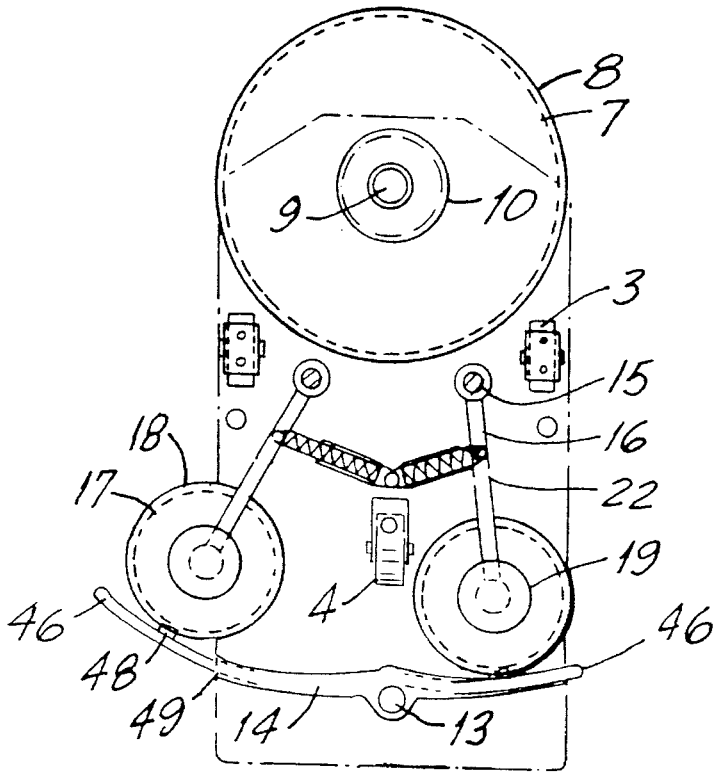
FIG. 6 is a horizontal cross section through a scrubber vacuum cleaner where the vacuum elements positioned behind the adjustable brushes and the fixed vacuum strip member form a telescoping unit.

The scrubber vacuum cleaner illustrated in FIG. 6 corresponds essentially to that of FIG. 4. It differs from the latter in that it has differently designed elements used for vacuuming up the water film. In this case the vacuum spouts 46 coupled with the adjustable brush 17 forms a telescoping extension of the central vacuum element 14. The vacuum element 14 passes around the two vacuum spouts 46 that are mounted to the supplemental brush hoods 18 by using retaining irons 48. At the outer ends 49 of the vacuum element 14 this strip is sealed by a plug against the vacuum spouts so that the inlet of adjacent air into the vacuum strip 14 will be prevented. The vacuum element 14 in this case is securely attached to the chassis and is connected, in the manner described, to the vacuum fan by means of a vacuum hose 13; a separate connection of the vacuum spouts 46 to the vacuum fan is not necessary.

Figure 7:
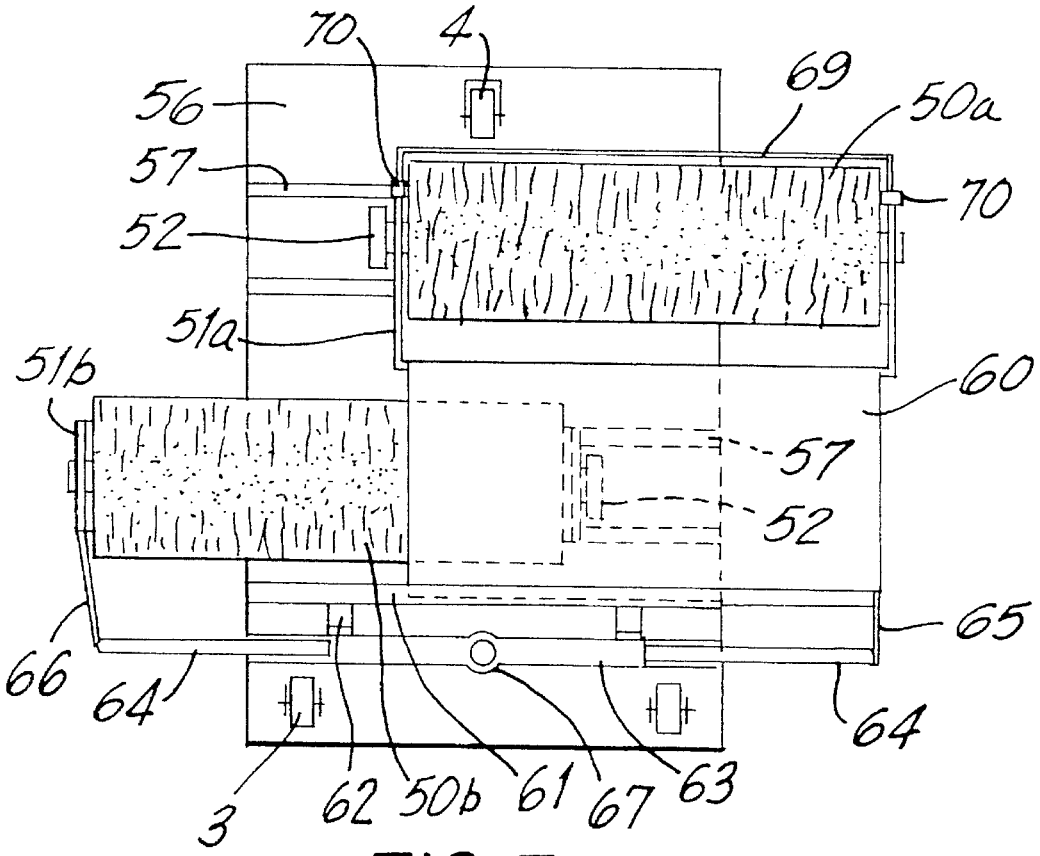
FIG. 7 is the view of the chassis, from below, of another embodiment of a floor scrubbing machine according to the invention.
Figure 8:
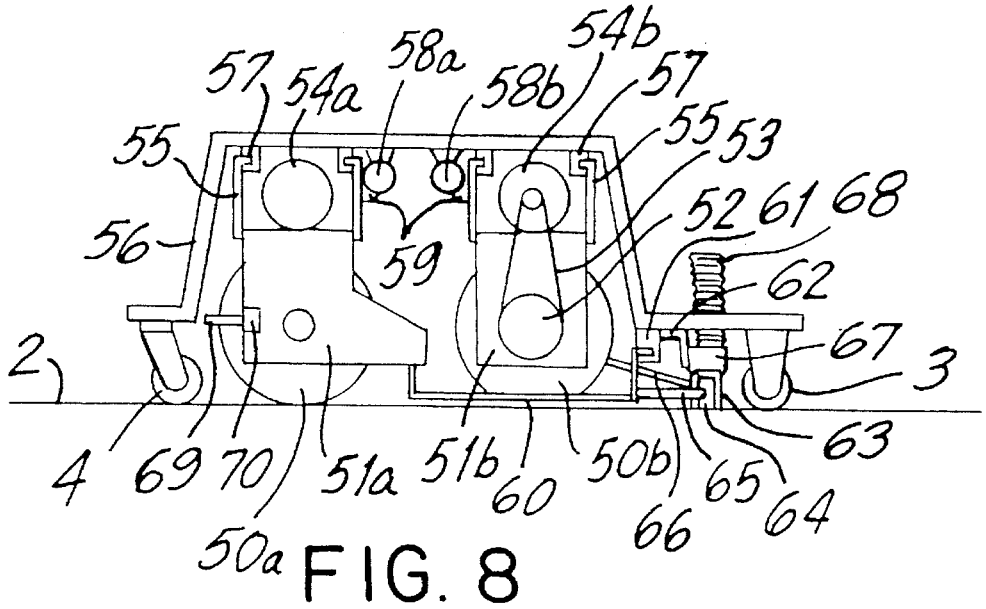
FIG. 8 is a side view of the chassis according to FIG. 7.

In contrast to the scrubber vacuum cleaners illustrated in FIGS. 1–6, the machine according to FIGS. 7 and 8 does not have any fixed brushes; rather it has two adjustable brushes located one behind the other and designed as roller brushes 50*a*, 50*b*. The roller brushes 50 are rotatably seated each in one downwardly open, U-shaped frame 51*a*, 51*b* rotating on axes running transverse to the working direction. At one end the shafts of the roller brushes 50*a*, 50*b* are each provided with a belt pulley 52. Around each of these belt pulleys 52 there is one toothed belt 53 that is driven by a drive motor 54*a*, 54*b* mounted on the upper surface of the frame 51*a*, 51*b*.

Each frame 51*a*, 51*b* is suspended from the chassis transverse to the working direction, where the two supports 55 located at the particular frame 51 run into guide elements 57 located at the underside of the chassis 56. The lateral displacement of the frame 51*a*, 51*b* with respect to the chassis 56 is used by two electromotors 58*a*, 58*b* located at the underside of the chassis, each of which acts by means of a worm gear on one spur rack 59 located on the respective, inner supports 55.

The cover plate 60 located in the region of the rear roller brush 50*b* is connected to the frame 51*a* of the front roller brush 50*a*. The rear edge of the cover plate 60 is mounted in the guide element 61 attached securely to the chassis so that said edge can slide to the side. Thus the cover plate 60 can follow the positional changes of the front roller brush 50*a* that is caused by the corresponding position change drive (electromotor 58*a*, spur rack 59*a*, support 55). It will always prevent the rear brush 50*b* from operating in the region of the floor where cleaning has already taken place by the front brush 50*a*.

The vacuum element 63 is open to the bottom and is in a U-shape and is also attached securely to the underside of the chassis 56 by means of two retaining irons 62; it is of extendable telescoping design. For this purpose, in its two ends, there is one vacuum element 64 slidably mounted so that the one vacuum element is coupled by means of the strut 65 with the cover plate 60, and the other vacuum element is coupled by means of the strut 66 to the frame 51*b* of the rear brush. The vacuum hose 68 moves upwards from the vacuum head 67 located centrally in the vacuum element 63; the vacuum head is connected to the vacuum fan (not illustrated) by means of this vacuum hose. The vacuum elements 64 will assume a position so that the working width of the vacuum device will correspond to the working width of the two brushes. This will occur due to the coupling of the vacuum elements to the brushes by means of struts 65 and 66.

The front edge of the front roller brush 50*a* is surrounded by a sensor bar 69 that acts on the two sensor switches 70 provided on the front frame 51*a*. The sensor switches 70 are connected across control lines (not illustrated) with the electromotor 58*a*, in order to control it in such a manner that the front roller brush will be moved in the direction of its retracted position when the outer sensor switch 70 is operated due to a contact of the sensor bar 69 with an obstacle.

The chassis 56 is set in a known manner onto the two idle rollers 3 and the guide roller 4 pivoting about a vertical axis.

I claim:

1. A floor scrubbing machine comprising a moving chassis, a floor scrubbing device and a suction device, said floor scrubbing device having scrubbing means (7, 17) including at least two rotating scrubbing elements (17), and means (16) for changing a position of at least one of said two rotating scrubbing elements (17) relative to said chassis so as to vary an operating width of said floor scrubbing device; said suction device including a vacuum head (12) and a vacuum element (14) coupled to said vacuum head and located at the bottom of the machine and in a working direction behind said floor scrubbing device, said scrubbing elements (17) being provided each with a scrubber member (20) for guiding particles and liquid located on the floor being treated to said vacuum head (12) and said vacuum element (14), said scrubber member (20) being respectively connected to said at least one rotating scrubbing element (17) so that the operating width of the suction device is adapted to the working width of the floor scrubbing device, said at least one rotating scrubbing element (17) being connected to said changing means (16) to be swingably mounted on said moving chassis on a swivel point (15) such that when said at least one rotating scrubbing element (17) is swung to a position thereof corresponding to one operating width of said scrubbing device, said at least one rotating scrubbing element is located at one side of said swivel point outwardly of said chassis and when said at least one rotating scrubbing element (17) is swung to another position thereof corresponding to a reduced operating width, said at least one rotating scrubbing element is located inwardly of said chassis.

2. A floor scrubbing machine according to claim 1, wherein each said scrubber member (20) is attached to an adjustable hood (18) covering the respective scrubbing element.

3. A floor scrubbing machine according to claim 1, wherein said scrubbing means include one fixed scrubbing element and two said rotating scrubbing elements (17) which are mounted moveably to one side across a working region of said fixed scrubbing element.

4. A floor scrubbing machine according to claim 1, wherein a pivot (15) of two adjustable scrubbing elements is provided at said swivel point, which is symmetrical with regard to a longitudinal axis of the machine.

5. A floor scrubbing machine according to claim 4, wherein said at least one rotating scrubbing element is articulated relative to the moving chassis by means of a pivot arm (16) of said changing means, said pivot arm pivoting about a vertical axis.

6. A floor scrubbing machine according to claim 1, wherein each said scrubbing element has a drive unit (19).

7. A floor scrubbing machine according to claim 1, wherein each scrubbing element is adjustable and is brought automatically into an extended position by a spring element (22, 39).

8. A floor scrubbing machine according to claim 1, wherein said at least two rotating scrubbing elements (17) are brushes.

9. A floor scrubbing machine according to claim 1, comprising at least one cover plate (23) for said at least one rotating scrubbing element, and another rotating scrubbing element, wherein said one rotating scrubbing element runs onto said cover plate in a region where another rotating scrubbing element is in contact with the floor so as to prevent double scrubbing of the floor in an area where said one and another rotating scrubbing elements (17) overlap each other.

* * * * *